US005190854A

United States Patent [19]

Goedeweeck

[11] Patent Number: 5,190,854

[45] Date of Patent: Mar. 2, 1993

[54] PHOTOGRAPHIC INFRA-RED SENSITIZED MATERIAL CONTAINING A SPEED ENHANCING AGENT

[75] Inventor: Rudi A. Goedeweeck, Herent, Belgium

[73] Assignee: AGFA-Gevaert, N.V., Mortsel, Belgium

[21] Appl. No.: 727,818

[22] Filed: Jul. 9, 1991

[30] Foreign Application Priority Data

Jul. 10, 1990 [EP] European Pat. Off. ..... 90201859.7

[51] Int. Cl.[5] ..... G03C 1/20; G03C 1/28

[52] U.S. Cl. ..... 430/576; 430/517; 430/522; 430/584; 430/600; 430/944; 430/945

[58] Field of Search ..... 430/517, 522, 573, 576, 430/584, 600, 944, 945

[56] References Cited

U.S. PATENT DOCUMENTS

| | | | |
|---|---|---|---|
| 3,849,658 | 11/1974 | Jeurissen et al. | 430/496 |
| 4,282,309 | 8/1981 | Laridon et al. | 430/281 |
| 4,536,473 | 8/1985 | Mihara | 430/576 |
| 5,057,405 | 10/1991 | Shiba et al. | 430/505 |

*Primary Examiner*—Charles L. Bowers, Jr.
*Assistant Examiner*—Janet C. Baxter
*Attorney, Agent, or Firm*—Breiner & Breiner

[57] ABSTRACT

A photographic laser recording material is disclosed comprising a transparent base and at least one emulsion layer containing a silver halide emulsion which is sensitized to the near infra-red by the combination of a heptamethine chain containing dye according to general formula (I) and a supersensitizer characterized in that said emulsion layer further contains a compound according to general formula (II):

(I)

wherein, $Z^1$ and $Z^2$ represent a non metallic atomic group necessary to complete a benzothiazole, benzoxazole, naphtothiazole or naphtoxazole nucleus; $R_5$ and $R_6$ each represent an alkyl or substituted alkyl group;

$R_1$, $R_2$, $R_3$, and $R_4$ each represent a hydrogen atom, a substituted or unsubstituted alkyl, alkoxy, amino, phenyl or benzyl group; $R_1$ and $R_3$, or $R_2$ and $R_4$ respectively may combine with each other to form a substituted or unsubstituted 5- or 6-membered ring;

$X-_n$ is an anion of the type commonly present in sensitizing dyes, e.g. bromide, chloride, iodide, methyl sulphate, p-tolyl sulphate; n is 0 or 1 (0 in case of an intramolecular salt via an anionic group in R).

(II)

wherein $R_{11}$, $R_{13}$, and $R_{14}$ each represent a hydrogen atom or a substituted or unsubstituted lower alkyl group and $R_{12}$ represents a substituted or unsubstituted alkyl or aryl group; the optionally substituted amino group is situated on the 6th or 7th position of the quinolone nucleus.

9 Claims, No Drawings

PHOTOGRAPHIC INFRA-RED SENSITIZED MATERIAL CONTAINING A SPEED ENHANCING AGENT

FIELD OF THE INVENTION

The present invention relates to silver halide photographic materials and more specifically to photographic emulsions and materials which are sensitized to the near infra-red spectral region for use in laser recording.

BACKGROUND OF THE INVENTION

Infra-red sensitized photographic materials are known for quite some time in photographic technology. One of the well-known early applications was and still is in aerial photography. The most familiar classes of infra-red sensitizing substances are long-chain cyanine dyes. Suitable infra-red sensitizing dyes are disclosed in e.g. U.S. Pat. Nos. 2,095,854, 2,095,856, 2,955,939, 3,482,978, 3,552,974, 3,573,921, 3,582,344, 3,623,881 and 3,695,888.

In recent years new techniques of image recording have emerged wherein the exposure source of the recording apparatus is a laser unit. So, for example, in the pre-press field of phototype- and image-setting, recorders are marketed which employ Ar ion lasers, He-Ne lasers or solid state semiconductor lasers, also called laserdiodes, as exposure source. This latter type of laser, the laserdiode, shows some advantages compared to other laser types such as low cost price, small size, long life time and no need for an acoustic-optical modulator. Generally the emission wavelength of these semiconductor laser beams is longer than 700 nm and mostly longer than 750 nm. So photographic materials appropriate for exposure by devices employing such laserdiodes must be sensitized for the near infra-red region of the radiation spectrum. Suitable photographic materials to be used with semiconductor laser device are disclosed in Japanese Unexamined Patent Publication (Kokai) No. 61752/85 and U.S. Pat. No. 4,784,933. Commercial infra-red sensitized film and paper were announced by EASTMAN KODAK Co. in "Proceedings Lasers in Graphics, Electronic Publishing in the '80's, Vol 2 (September 1985) p. 508. Other manufacturers include AGFA-GEVAERT N.V. and FUJI PHOTO Ltd. An example of an image-setter using a laserdiode exposure is the CG 9400 apparatus marketed by AGFA COMPUGRAPHIC, a division of AGFA CORPORATION.

Another rather recent application of lasers as exposure units is situated in the field of radiographic monitoring photography where a hard copy of radiographic information has to be produced. The laser imager or recorder is an optical/electronic/machanical device which forms an alternative for the more conventional video imager. In a video imager one image is captured on a CRT and photographed. In a laser imager the digital image information required for one film sheet is put, via an interface, into a memory store. At the moment of recording, the full information stored in the memory is used to modulate the laser beam via an acoustic-optical modulator (except in the case of laserdiodes) in terms of brightness, grey levels etc. The radiographic information, originating e.g. from a CT-scan or a NMR-scan, is written line per line on the photographic output material e.g. in a horizontal plane while the photographic material itself is moved in a vertical direction. Although the video imager shows some advantages such as faster data transfer resulting in a shorter exposure time, less complicated interfacing and less susceptibily to dust and vibration, the laser imager shows the far better overall picture quality thanks to the higher resolution. Most laser recorders use HeNe lasers which require red sensitized output materials, e.g. the laser imager marketed by AGFA MATRIX, a division of AGFA CORPORATION. However the widely used laser recorder marketed by MINNESOTA MINING AND MANUFACTURING Co operates by means of a laserdiode emitting at 820 nm. So again for this type of device a hard copy medium sensitized to the near infra-red is needed.

A permanent problem in the field of imaging by laserdiodes is the sensitivity level of the infra-red sensitized photographic material. A first reason for that is made up by the low energy output of the laserdiode which is in the order of a few milli-Watts. A second problem consists in the usually poor storage quality of emulsions sensitized with long-chain cyanine dyes unless considerable amounts of stabilizers are used; however it is generally known that such a strong stabilization tends to reduce the original sensitivity level. An at least partial remedy for the sensitivity problems in infra-red photographic materials was found in the use of so-called "supersensitizers". Suitable supersensitizers are disclosed e.g. in U.S. Pat. No. 3,695,888, in U.S. Pat. No. 4,603,104 and in Research Disclosure Item 28952, published in May 1988. Although the sensitivity of infra-red materials is greatly improved by the use of supersensitizers it can still be insufficient; so there is a permanent need for new ways of enhancing this sensitivity.

It is an object of the present invention to provide a new way of improving the speed of infra-red sensitized photographic emulsions.

It is another object of the present invention to provide hard copy photographic materials, coated on a transparent base, for laserdiode recording, which show the desired sensitivity.

SUMMARY OF THE INVENTION

It was surprisingly found that the sensitivity of photographic emulsions coated on a transparent base and sensitized to the infra-red by the combination of a heptamethine chain containing infra-red sensitizing dye according to general formula (I) and a supersensitizer could be considerably enhanced by further incorporating in the photographic material a compound according to general formula (II):

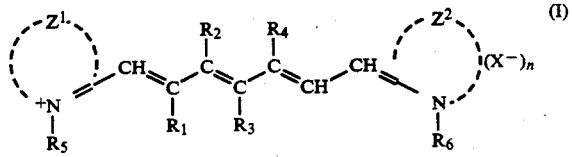

(I)

wherein, $Z^1$ and $Z^2$ represent a non metallic atomic group necessary to complete a benzothiazole, benzoxazole, naphtothiazole or naphtoxazole nucleus; $R_5$ and $R_6$ each represent an alkyl or substituted alkyl group;

$R_1$, $R_2$, $R_3$, and $R_4$ each represent a hydrogen atom, a substituted or unsubstituted alkyl, alkoxy, amino, phenyl or benzyl group; $R_1$ and $R_3$, or $R_2$ and $R_4$ respectively may combine with each other to form a substituted or unsubstituted 5- or 6-membered ring;

$X^-_n$ is an anion of the type commonly present in sensitizing dyes, e.g. bromide, chloride, iodide, methyl sulphate, p-tolyl sulphate; n is 0 or 1 (0 in case of an intramolecular salt via an anionic group in $R_5$).

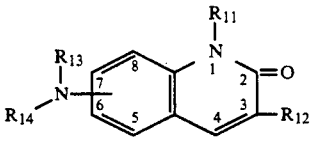

(II)

wherein $R_{11}$, $R_{13}$, and $R_{14}$ each represent a hydrogen atom or a substituted or unsubstituted lower alkyl group and $R_{12}$ represents a substituted or unsubstituted alkyl or aryl group; the optionally substituted amino group is situated on the 6th or 7th position of the quinolone nucleus;

Although some compounds represented by general formula (II) were previously known as brightening agents for use in photographic papers, it is the first time that their use as sensitivity enhancing agents in materials coated on a transparent base is disclosed. The present invention is even more surprising because under the circumstance of a transparent support the brightening action of these compounds is superfluous and the speed enhancing property on the infra-red emulsions as referred to herebefore was impossible to predict.

Infra-red sensitized materials containing the compounds of the present invention are suited for laser recording in devices which employ laserdiodes as exposure source; preferably they are used as hard copy output materials for laser recording of radiographic information.

DETAILED DESCRIPTION OF THE INVENTION

Preferred chemical classes of a heptamethine chain containing infra-red sensitizers in connection with the present invention are represented by general formula I-a and I-b:

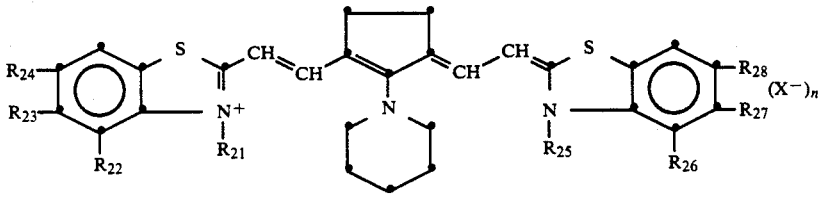

(I-a)

wherein $R_{21}$ and $R_{25}$, each represent alkyl or substituted alkyl; $R_{22}$, $R_{23}$, $R_{24}$, $R_{26}$, $R_{27}$ and $R_{28}$ each represent alkyl, alkoxy or a halogen atom; $X^-$ is an anion; n is 0 or 1 (0 in case of an intramolecular salt via an anionic group in $R_{21}$)

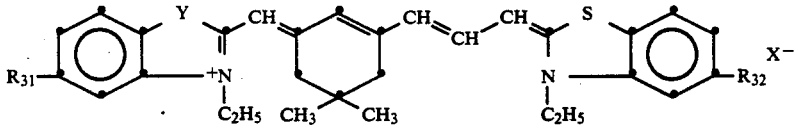

(I-b)

wherein $R_{31}$ and $R_{32}$ each represent a hydrogen atom, substituted or unsubstituted alkyl or aryl, or a halogen atom; Y is an oxygen or a sulphur atom; $X^-$ is an anion;

Specific examples of IR-sensitizers represented by general formula I-a are the following compounds:

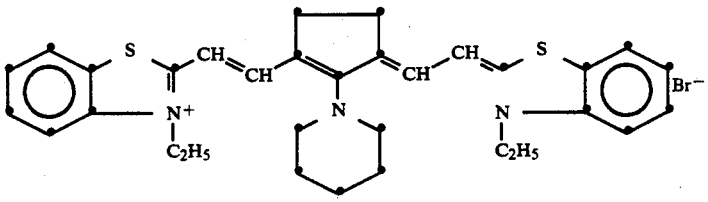

(I-a1)

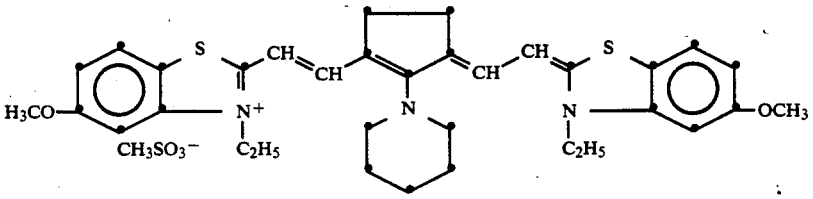

(I-a2)

-continued
(I-a3)
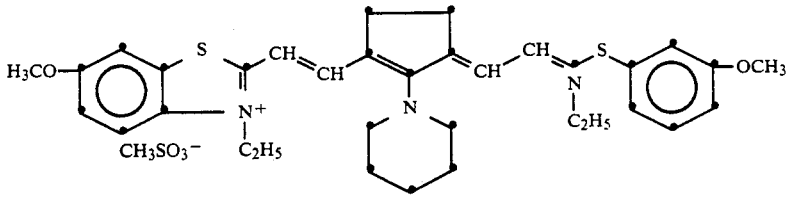
(I-a4)
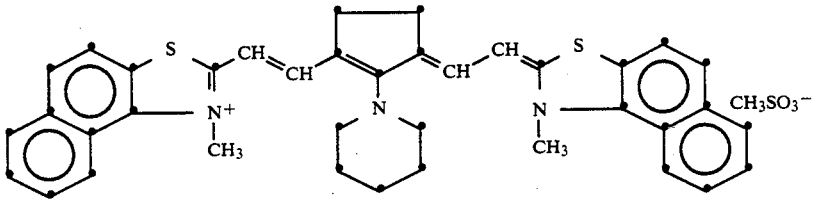
(I-a5)
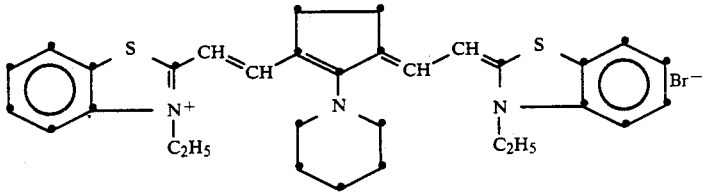
(I-a6)
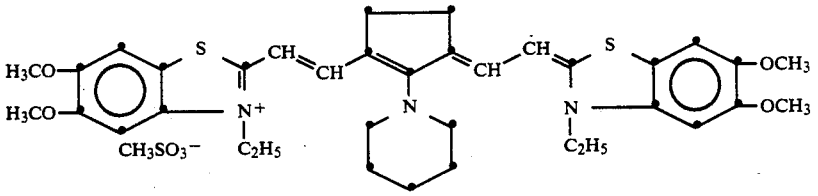
(I-a7)
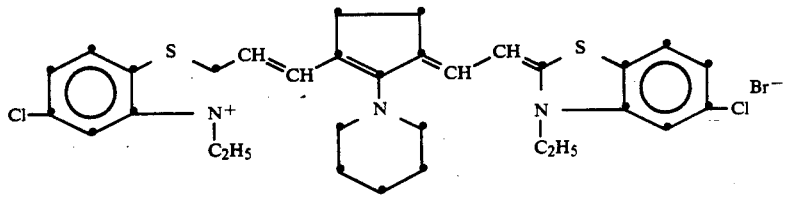
Specific examples of IR-sensitizers of use in accordance with the present invention represented by general formula I-b are the following compounds:
(I-b1)
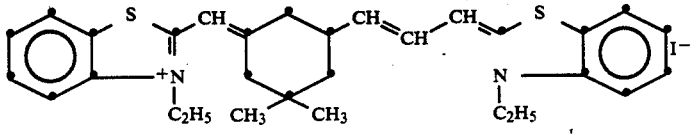
(I-b2)
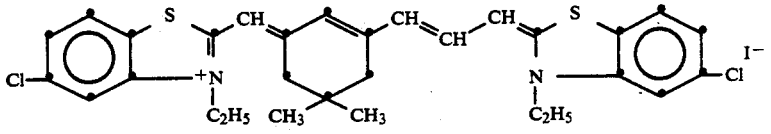
(I-b3)
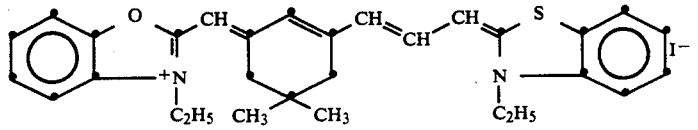

-continued

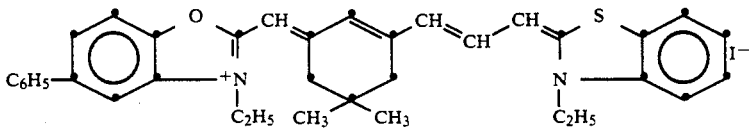

(I-b4)

The following substances represent specific examples of the compounds according to general formula (II) in connection with the present invention:

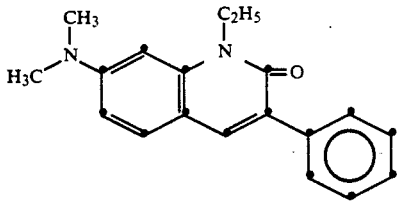

(II-1)

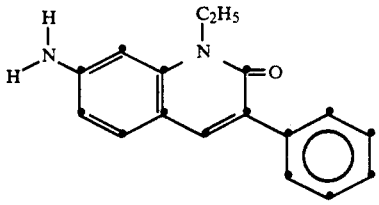

(II-2)

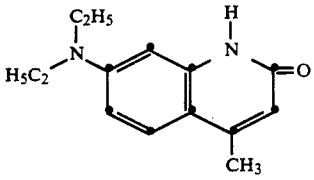

(II-3)

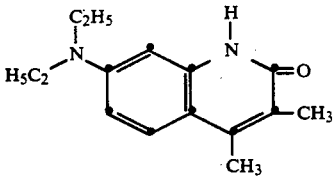

(II-4)

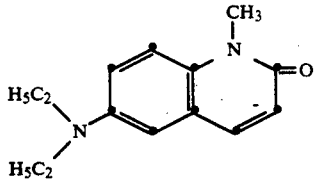

(II-5)

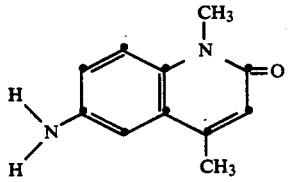

(II-6)

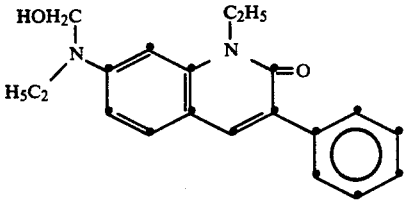

(II-7)

-continued

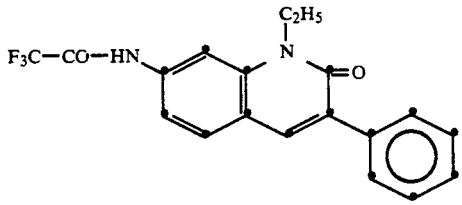

(II-8)

The infra-red sensitizers used in accordance with the present invention can be combined with any supersensitizer. A preferred class of supersensitizers consists of water-soluble heterocyclic mercapto-compounds comprising a thiazole, benzothiazole, naphthothiazole, or quinoline ring system, which ring system may be substituted or not, and also comprising at least one electronegative group e.g. halogen, sulfo, sulphonamide, carboxy and phenyl.

Specific examples of this preferred class of supersensitizers are the following compounds:

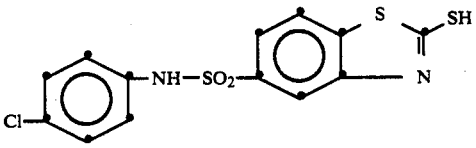

(III-1)

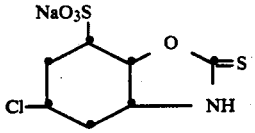

(III-2)

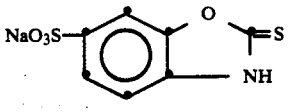

(III-3)

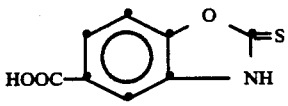

(III-4)

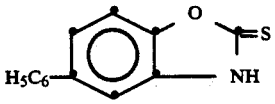

(III-5)

The heptamethine chain containing infra-red sensitizing dyes, the supersensitizers and the compounds represented by general formula (II) are all incorporated in the emulsion layer(s) of the photographic material in order to exercise their photographic functions properly. The IR-sensitizers are usually added as solutions in an organic solvent. The preferred classes of supersensitizers usually represent water-soluble substances. The compounds according to general formula (II) are preferably incorporated in the emulsion layer with the help of a latex, preferably a polyurethane latex loaded with the substance in question. A preferred polyurethane latex is sold under the trade name IMPRANIL 43056 by BAYER A. G. and consists of a 40% aqueous dispersion of a polyurethane prepared from DESMODUR W (trade name), which is a dicyclohexylmethane diisocyanate also sold by BAYER A. G., and a polyester having a low molecular weight of about 800. The average particle size of the latex may vary between 0.02 and 0.2 micron. The binding agent of the loaded latex preferably is gelatin.

For most purposes the emulsion layer of the photographic material consists of a single layer but principally a double or even a multiple emulsion layer can be present.

The halide composition of the silver halide emulsions used according to the present invention is not specifically limited and may be any composition selected from e.g. silver chloride, silver bromide, silver iodide, silver chlorobromide, silver bromoiodide, and silver chlorobromoiodide.

The photographic emulsions can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). They can be prepared by mixing the halide and silver solutions in partially or fully controlled conditions of temperature, concentrations, sequence of addition, and rates of addition. The silver halide can be precipitated according to the single-jet method, the double-jet method, the conversion method or an alternation of these different methods.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The average size of the silver halide grains may range from 0.05 to 1.0 micron, preferably from 0.2 to 0.5 micron. The size distribution of the silver halide particles of the photographic emulsions to be used according to the present invention can be homodisperse or heterodisperse.

The silver halide crystals can be doped with $Rh^{3+}$, $Ir^{4+}$, $Cd^{2+}$, $Zn^{2+}$ or $Pb^{2+}$.

The emulsion can be desalted in the usual ways e.g. by dialysis, by flocculation and re-dispersing, or by ultrafiltration.

The light-sensitive silver halide emulsions are preferably chemically sensitized as described e.g. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The silver halide emulsion(s) for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazolinethione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-Appl. 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are metal salts such as e.g. mercury or cadmium salts and the compounds described in Research Disclosure No. 17643 (1978), Chapter VI.

The fog-inhibiting agents or stabilizers can be added to the silver halide emulsion prior to, during, or after the ripening thereof and mixtures of two or more of these compounds can be used.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose, derivatives such as hydroxyalkyl cellulose, carboxymethyl cellulose, phthaloyl cellulose, and cellulose sulphates.

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952.

Beside the light sensitive emulsion layer(s) the photographic material can contain several non light sensitive layers, e.g. a protective top layer, one or more backing layers, and one or more intermediate layers eventually containing light-absorbing dyes. Suitable light-absorbing dyes are described in e.g. U.S. Pat. Nos. 4,092,168, 4,311,787, DE 2,453,217, and GB 7,907,440. Such light-absorbing dyes can exercise several photographic functions. They can be used as filter dyes for the purpose of protecting the underlying layer(s) from the action of the light corresponding to the wavelength they absorb. They can also function as so-called screening dyes in order to promote image sharpness. Very important is the use of light-absorbing dyes as antihalation dyes in order to reduce the reflection of light by a transparent support onto the light sensitive layer(s). A preferred light-absorbing dye which can be used in accordance with the present invention as filter-, screening- or antihalation dye thanks to its absorption in the infra-red is the following compound IV-1:

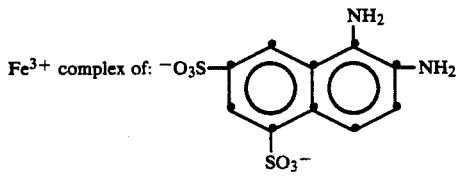

(IV-1)

Infra-red sensitized photographic materials of the present invention are preferably manufactured and treated in severe safelight conditions, e.g. faint cyan light. A preferred cyan light absorbing filter dye which may be incorporated in one of the hydrophilic layers of the photographic materials of the invention shows following chemical formula IV-2:

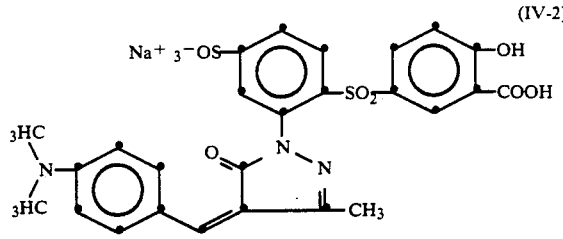

(IV-2)

One or more backing layers can be provided at the non-light sensitive side of the support. These layers which can serve as anti-curl layer can contain e.g. lubricants, antistatic agents, light absorbing dyes, etc.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration. Preferred surface-active coating agents are compounds containing perfluorinated alkyl groups.

The photographic elements of the present invention may further comprise various other additives such as e.g. compounds improving the dimensional stability of the photographic element, UV-absorbers, spacing agents and plasticizers.

Suitable additives for improving the dimensional stability of the photographic elements are e.g. dispersions of a water-soluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Spacing agents can be present, preferably in the top protective layer; in general the average particle size of such spacing agents is comprised between 0.2 and 10 micron. They can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The support of the photographic materials according to the present invention is transparent, preferably an organic resin support, e.g. cellulose nitrate film, cellulose acetate film, poly(vinyl acetal) film, polystyrene film, poly(ethylene terephthalate) film, polycarbonate film, polyvinylchloride film or poly-Alpha-olefin films such as polyethylene or polypropylene film. The thickness of such organic resin film is preferably comprised between 0.07 and 0.35 mm. These organic resin supports are preferably coated with a subbing layer. In the preferred embodiment of a photographic material for laser recording of radiographic information the support is preferably blue coloured showing a density of about 0.16.

The photographic materials according to the invention can be processed by any means or any chemicals known in the art depending on their particular application. In the case of infra-red sensitive elements in the field of graphic arts for phototype- or image-setting they are preferably processed in so-called "Rapid Access" chemicals, comprising a conventional phenidone/hydrochinon developing solution and a conventional sodium or ammonium thiosulphate containing fixing solution. Alternatively they can be processed in so-called "hard dot Rapid Access" chemistry, e.g. the AGFASTAR system marketed by AGFA. Preferably a automatically operated processor provided with automatic regeneration is used, e.g. a RAPILINE device marketed by AGFA. In the preferred embodiment of a laser recording material for radiographic information the processing is preferably performed in a 90 seconds cycle at 35° C. in a commercial processor, e.g. a KODAK M6 processor, marketed by EASTMAN KODAK Co or a CURIX U 242 processor marketed by AGFA.

The following examples illustrate the present invention without however limiting it thereto.

EXAMPLE 1

1.95 l of a 1 molar silver nitrate solution and 1.225 l of a solution containing 0.6 moles/l of sodium bromide, 1.2 moles/l of sodium chloride, 0.01 moles/l of sodium iodide and $1.5\times10^{-6}$ moles/l of sodium hexachloroiridate were added whilst stirring to a solution of 110 g inert gelatin in 2.8 l of water by a double jet precipitation technique at 48° C. during 15 min. After 5 min of physical ripening a double jet precipitation was performed during 9 min by adding 1.05 l of a 1 molar silver nitrate solution and 0.74 l of a 1.68 molar sodium chloride solution. After 10 min of physical ripening pH was adjusted to 3.5 by means of diluted sulphuric acid and the emulsion was flocculated by adding polystyrene sulphonic acid. After washing with cold water the flocculate is peptizised and by adding inert gelatin an emulsion was obtained containing 200 g of silver halide expressed as silver nitrate and 90 g of gelatin per kg. The silver halide crystals had a (100) habitus with an average grain size of 0.22 micron and consisted of a core accounting for 65% of the precipitated silver, showing a 2:1 chloride/bromide ratio and containing 0.64 molar % of iodide; the shell consisted of pure silver chloride and had a thickness of only 0.02 micron.

2.5 kg of this emulsion were chemically sensitized by adding $6.32\times10^{-5}$ moles of sodium thiosulphate, $4.37\times10^{-5}$ moles of aurochloric acid, $4.73\times10^{-4}$ toluenethiosulphonic acid and $1.98\times10^{-4}$ moles of sodium sulphite per mole silver halide, maintaining temperature at 50° C., pH at 5.25 and pAg at 7.7. After 3 h phenol was added as a bactericide and the emulsion was cooled down and solidified.

In the final step of the preparation the emulsion was reliquefied and inert gelatin was added to obtain a gelatin/silver halide ratio of 0.5. To one half of this emulsion (emulsion A=controle sample) were added successively following compounds per mole silver nitrate:

1.75 g, dissolved in 40 ml of water, of stabilizer 4-hydroxy-6-methyl-1,3,3a,7-tetraazaindene;

0.60 g, dissolved in 30 ml of water, of supersensitizer III-1;

0.037 g, dissolved in 75 ml of methanol, of IR-sensitizer I-b1;

0.23 ml of a wetting agent with chemical formula:

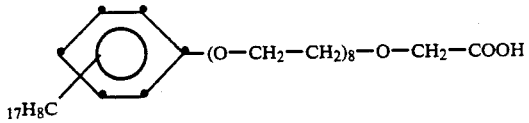

0.039 g, dissolved in 5 ml of ethanol, of phloroglucinol;

0.30 g, dissolved in 30 ml of ethanol, of stabilizer 5-nitro-indazole;

0.90 g, dissolved in 10 ml of water, of filter dye IV-1; pH is adjusted to 5.0 by means of citric acid.

To the other half (emulsion B) were added 1.7 g of compound II-1, loaded on a polyurethane latex, sold under the trade name IMPRANIL 43056 and thereupon the same solutions as for emulsion A. The preparation of both samples was repeated but in this case an extra solution of 7.0 g of filter dye IV-2 dissolved in 60 ml of water was added resulting in emulsion samples C and D.

These four emulsions were coated on a polyethyleneterephtalate base at 4.5 g Ag/m$^2$ expressed as silver nitrate. At the same time a protective top layer was coated at 1 g gelatin per m$^2$ using formaldehyde as a hardener. A backing layer was applied containing 3.25 g gelatin per m$^2$ and anti-halation dye IV-1 in a sufficient concentration to provide for a density of 0.4 measured at 820 nm. The four coated photographic elements were subjected to a scanning exposure by means of a laserdiode with following scan characteristics: spot diameter 1/e$^2$ (pixel size)=92 micron, exposure time per pixel=400 ns, pitch (distance between two scan lines)=54 micron, wavelength=820 nm and energy output=3.4 mW. A continuous tone wedge consisting of carbon black with a wedge constant of 0.15 was employed. An exposure time of 33 s was applied.

The processing was performed in a conventional processor during 90 seconds at 35° C. The developer was a conventional phenidone/hydrochinon developer containing sulphite and development restrainers. The fixing solution conventionally contained ammoniumthiosulphate.

Table 1 shows the sensitometric results whereby:

S: sensitivity expressed as relative log Et; lower figure means higher sensitivity;

gradation: slope of the sensitometric curve measured between densities 1+fog and 2+fog;

TABLE I

| Emulsion | amount of substance(s) per mole silver halide | IR-sensitometry fog | S | grad. | Dmax | remark |
|---|---|---|---|---|---|---|
| A | — | 0.10 | 2.31 | 2.03 | 2.83 | controle |
| B | 1.7 g II-1 | 0.11 | 2.07 | 2.76 | 3.48 | invention |
| C | 7.0 g IV-2 | 0.13 | 2.19 | 2.08 | 3.09 | invention |
| D | 1.7 g II-1 + 7.0 g IV-2 | 0.17 | 2.06 | 2.83 | 3.26 | invention |

The results of table 1 illustrate clearly the speed enhancing effect of compound II-1 according to the present invention. It should be noted that filter dye IV-2 itself shows a speed enhancing effect (sample C) although smaller than compound II-1.

EXAMPLE 2

2 l of a 1.5 molar silvernitrate solution and 2.155 l of a 1.33 molar potassium bromide solution were added in 30 min whilst stirring by a double jet precipitation technique to a solution of 27 g of methionine and 50 g of inert gelatin in 1.5 l water, while maintaining pAg at 8.5. After 15 min of physical ripening the emulsion was flocculated by the addition of polystyrene sulphonic acid and adjustment of pH to 3.0 by means of sulphuric acid. Water and inert gelatin were added after washing and redispersion in order to obtain an emulsion containing 200 g of silver halide, expressed as silver nitrate, and 80 g of gelatin per kg. This cubical silver bromide emulsion had an average grain size of 0.35 micron.

Before the start of the chemical sensitization pH was adjusted to 6.5 and pAg to 7.0 at 48° C. Then were added $2.37\times10^{-5}$ moles of sodium thiosulphate, $2.55\times10^{-5}$ moles of aurochloric acid, $2.76\times10^{-4}$ moles of ammonium thiocyanate and $3.81\times10^{-5}$ moles of toluenethiosulphonic acid per mole silver halide. After finishing the chemical ripening the emulsion was cooled down, pAg was adjusted to 8.0 by means of potassium bromide and phenol was added as bactericide.

The emulsion was divided in aliquot portions and the preparation was finished in the same way as emulsion A of example 1 except that the gelatin/silver halide ratio was 0.57, 7.38 g of dye IV-1 in 82 ml water per mole silver halide were added, and varying amounts of compound II-1 and supersensitizer III-1 were added according to table 2. The samples were adjusted to pH 5.5 and coated at 3.8 g Ag/m$^2$ expressed as $AgNO_3$. Exposure and processing were identical to example 1. The sensitometric evaluation occured according to example 1 except that the gradation was measured at two different portions of the sensitometric curve:

grad 1: slope between densities 0.4+fog and 1.0+fog;
grad 2: slope between densities 1.8+fog and 2.4+fog.

TABLE 2

| emulsion | amount II-1 per mole AgX | amount III-1 per mole AgX | IR-sensitometry fog | S | grad 1 | grad 2 | Dm | remark |
|---|---|---|---|---|---|---|---|---|
| E | — | 0.3 g | 0.16 | 1.91 | 2.52 | 3.77 | 3.28 | controle |
| F | 1.7 g | 0.3 g | 0.18 | 1.54 | 2.58 | 3.92 | 3.14 | invention |
| G | — | 0.6 g | 0.14 | 2.01 | 2.65 | 4.43 | 3.34 | controle |
| H | 1.7 | 0.6 g | 0.15 | 1.52 | 2.67 | 4.25 | 3.20 | invention |

Table 2 again shows the pronounced effect on sensitivity of compound II-1 according to the invention.

I claim:

1. Photographic laser recording material comprising a transparent base and at least one emulsion layer containing a silver halide emulsion which is sensitized to the near infra-red by the combination of a heptamethine chain containing dye according to general formula (I) and a supersensitizer characterized in that said emulsion layer further contains a compound according to general formula (II):

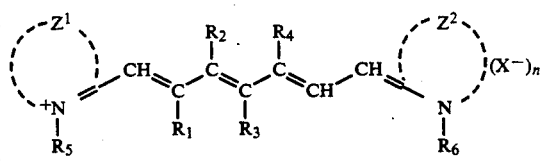

(I)

wherein, $Z^1$ and $Z^2$ represent a non metallic atomic group necessary to complete a benzothiazole, benzoxazole, naphtothiazole or naphtoxazole nucleus; $R_5$ and $R_6$ each represent an alkyl;

$R_1$, $R_2$, $R_3$, and $R_4$ each represent a hydrogen atom, a substituted or unsubstituted alkyl, alkoxy, amino, phenyl or benzyl group; $R_1$ and $R_3$, or $R_2$ and $R_4$ respectively may combine with each other to form a 5- or 6-membered ring;

$X^-$ is an anion n is 0 in case of an intramolecular salt via an anionic group in R or otherwise 1, wherein $R_{11}$, $R_{13}$, and $R_{14}$ each represent a hydrogen atom or a lower alkyl group and $R_{12}$ represents an alkyl or aryl group.

2. Photographic laser recording material according to claim 1 wherein the said infra-red sensitizer is chosen from the list of following chemical compounds I-a1 and I-b1:

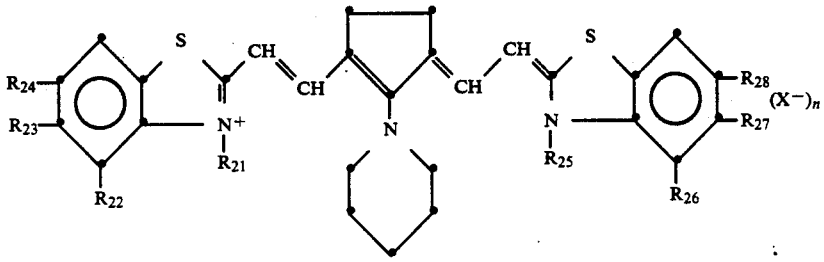

(I-a)

wherein $R_{21}$ and $R_{25}$, each represent alkyl: $R_{22}$, $R_{23}$, $R_{24}$, $R_{26}$, $R_{27}$ and $R_{28}$ each represent alkyl, alkoxy or a halogen atom; X is an anion; n is 0 or 1 (0 in case of an intramolecular salt via an anionic group in $R_{21}$)

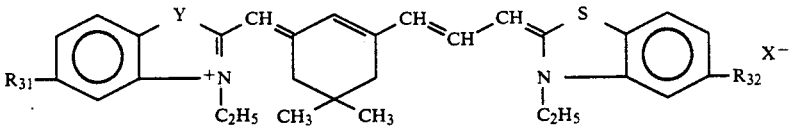

wherein $R_{31}$ and $R_{32}$ each represent a hydrogen atom, substituted or unsubstituted alkyl or aryl, or a halogen atom; Y is an oxygen or a sulphur atom; $X^-$ is an anion.

3. Photographic laser recording material according to claim 1 wherein the said infra-red sensitizer is chosen from the list of following chemical compounds I-a1 and I-b1:

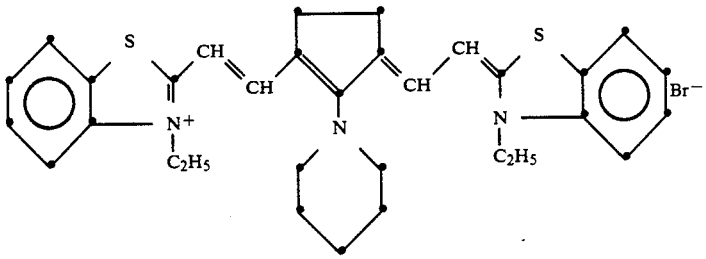

(I-a1)

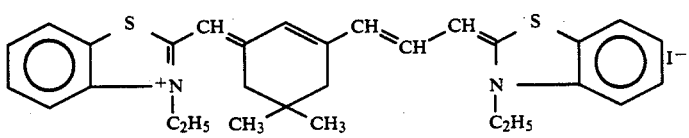

(I-b1)

4. Photographic laser recording material according to claim 1 wherein the said compound corresponding to general formula (II) is the following substance II-1:

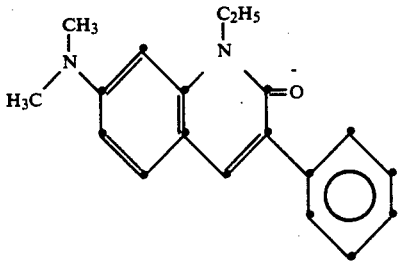

(II-1)

5. Photographic laser recording material according to claim 1 wherein the said supersensitizer is a water-soluble heterocyclic mercapto compound wherein the heterocyclic portion of the supersensitizer is selected from the group consisting of thiazole, benzothiazole, naphthothiazole, and quinoline comprising at least one electronegative group.

6. Photographic laser recording material according to claim 5 wherein the said supersensitizer is the following substance III-1:

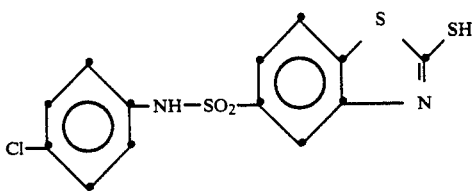

(III-1)

7. Photographic laser recording material according to claim 1 wherein the said emulsion layer further contains a filter dye for absorbing cyan safety light.

8. Photographic laser recording material according to claim 7 wherein the said filter dye is the following substance IV-2:

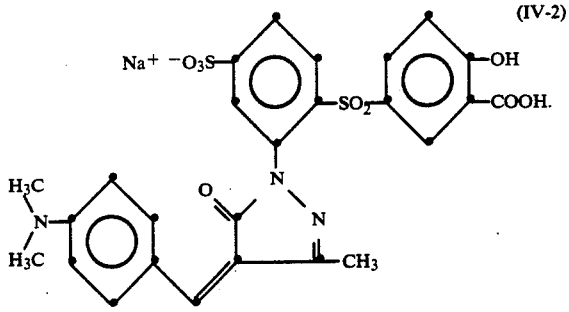

(IV-2)

9. Photographic laser recording material according to claim 1 wherein the said photographic laser recording material is a laser recording material for radiographic information.

* * * * *